United States Patent [19]

Cheary et al.

[11] 4,413,303

[45] Nov. 1, 1983

[54] IGNITION SYSTEMS

[75] Inventors: Clifford M. Cheary, Boldmere; David J. Lancaster, Tamworth; Paul P. Smith, Lichfield, all of England

[73] Assignee: Dunlop Limited, London, England

[21] Appl. No.: 276,539

[22] Filed: Jun. 23, 1981

[30] Foreign Application Priority Data

Jul. 5, 1980 [GB] United Kingdom ..... 8022109

[51] Int. Cl.[3] ..... F23Q 3/00

[52] U.S. Cl. ..... 361/253; 431/25; 431/66; 431/71

[58] Field of Search ..... 361/253, 256, 257; 431/25, 46, 69, 71, 66

[56] References Cited

U.S. PATENT DOCUMENTS

| | | | |
|---|---|---|---|
| 3,632,285 | 1/1972 | Foster | 361/256 |
| 3,662,185 | 5/1972 | Sapir | 361/256 |
| 3,894,273 | 7/1975 | Newport, Jr. et al. . | |
| 3,914,092 | 10/1975 | Matthews . | |
| 3,955,910 | 5/1976 | Matthews . | |
| 4,025,284 | 5/1977 | Horn et al. | 361/257 |
| 4,034,270 | 7/1977 | Matthews . | |
| 4,086,048 | 4/1978 | Carlson | 361/256 |
| 4,167,767 | 9/1979 | Courier de Méré | 361/256 |

FOREIGN PATENT DOCUMENTS

| | | |
|---|---|---|
| 780422 | 7/1957 | United Kingdom . |
| 795187 | 5/1958 | United Kingdom . |
| 819099 | 9/1959 | United Kingdom . |
| 1041096 | 9/1966 | United Kingdom . |
| 1046967 | 10/1966 | United Kingdom . |
| 1058099 | 2/1967 | United Kingdom . |
| 1082425 | 9/1967 | United Kingdom . |
| 1143210 | 2/1969 | United Kingdom . |
| 1220925 | 1/1971 | United Kingdom . |
| 1233241 | 5/1971 | United Kingdom . |
| 1277402 | 6/1972 | United Kingdom . |
| 1284427 | 8/1972 | United Kingdom . |
| 1310102 | 3/1973 | United Kingdom . |
| 1396280 | 6/1975 | United Kingdom . |
| 1427709 | 3/1976 | United Kingdom . |
| 2009386 | 6/1979 | United Kingdom . |
| 1561713 | 2/1980 | United Kingdom . |
| 1594349 | 7/1981 | United Kingdom . |

*Primary Examiner*—C. C. Shaw

*Attorney, Agent, or Firm*—Stevens, Davis, Miller & Mosher

[57] ABSTRACT

An electrical ignition system for a burner in which a spark generation circuit is arranged to charge a capacitor in one sense, and in which a flame sensing device charges the capacitor in the opposite sense, a detector circuit being provided to monitor the presence and polarity of a charge on the capacitor.

7 Claims, 7 Drawing Figures

FIG. 2
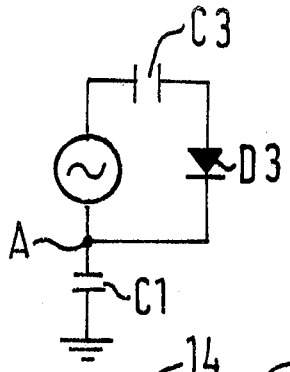
FIG. 3
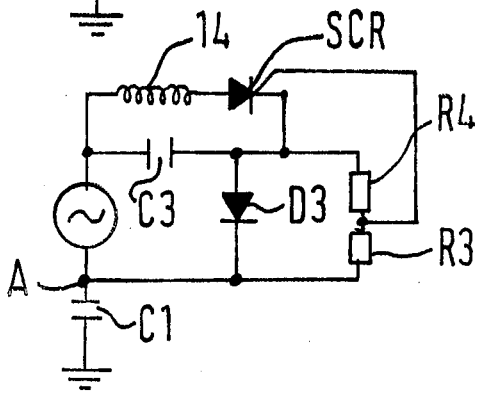
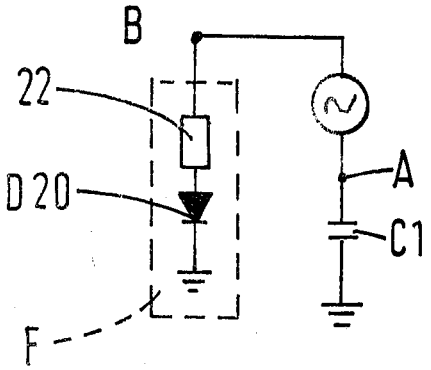
FIG. 4

IGNITION SYSTEMS

This invention relates to electrical ignition systems for burners, for example gas burners.

A common form of ignition system for a gas burner comprises an ignition spark generation system and means for monitoring the production of the spark and the subsequent presence of a flame.

One object of the present invention is to provide an improved electrical ignition system for a burner having facilities for monitoring the production of a spark. Preferably the system should also have facilities for monitoring the presence of a flame.

According to one aspect of the invention an electrical ignition system for a burner comprises a spark generation circuit, means for monitoring the production of a spark comprising a capacitor arranged to be charged in one sense by operation of the spark generation circuit, means for monitoring the presence of a flame comprising means responsive to the flame so as to produce a charge on the said capacitor in the opposite sense to that produced by operation of the spark generation circuit, and means for detecting the presence and polarity of a charge on the said capacitor.

One embodiment of the invention will now be described by way of example with reference to the accompanying drawings, in which:

FIGS. 2, 3 and 4 are simplified circuit diagrams illustrating the functions of parts of the circuit of FIG. 1;

Figure 1:
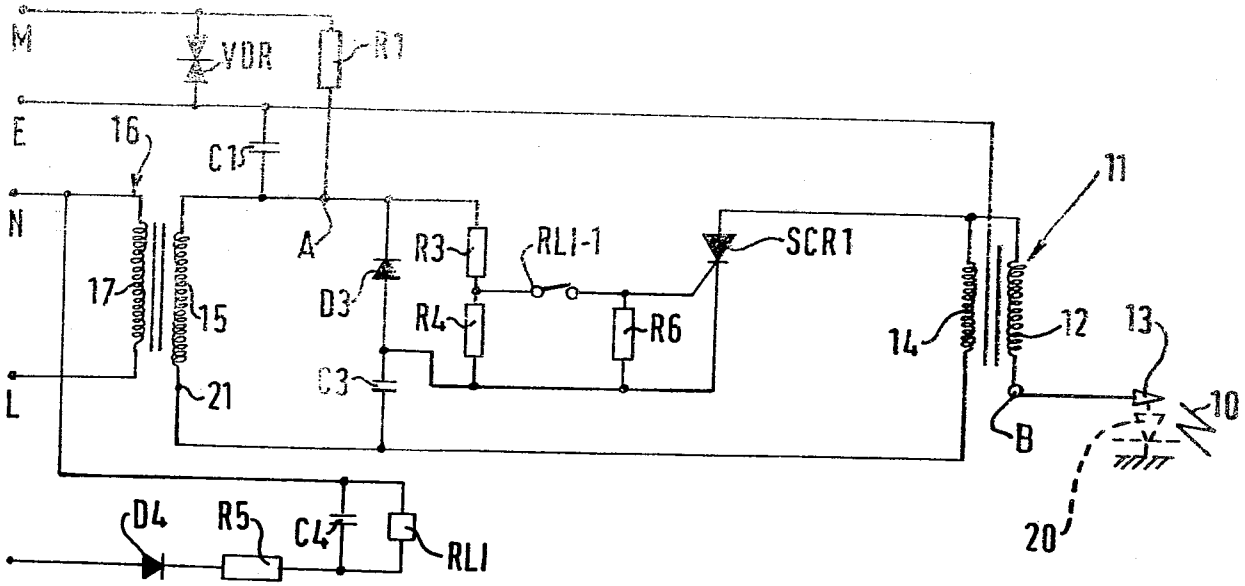
FIG. 1 is a circuit diagram of part of a spark generation and monitoring circuit.
Figure 5:
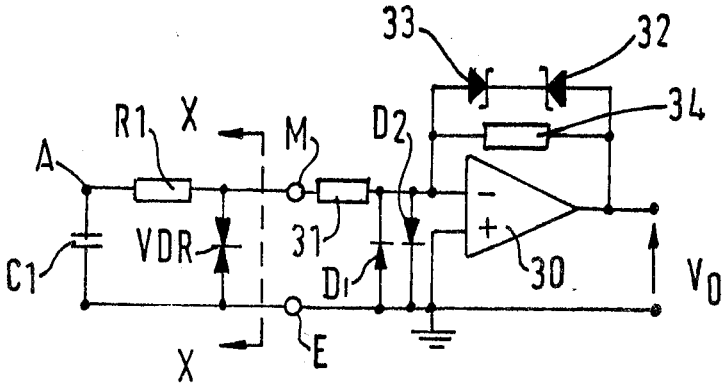
FIG. 5 is a circuit diagram of an additional part of the circuit shown in FIG. 1.

The circuit shown in FIG. 1 is designed to produce a series of sparks 10 in order to ignite a gas/air mixture emerging from a pilot torch to provide a pilot flame for the ignition of a large industrial burner. Automatic or manually operated controls for the burner need to be provided so as to enable an operator to ensure that the main burner gas supply is not turned on until the pilot flame is alight and ready to ignite it, and the apparatus shown in FIG. 1, in combination with that of FIG. 5, is designed to provide signals which indicate the presence of such a flame. The circuit also has a facility for monitoring its own function in the production of a spark so that the supply of gas to the pilot torch may be blocked it no spark is present to ignite it.

The spark generation circuit comprises a spark transformer 11 in which the secondary winding 12 is connected to a spark electrode 13. The primary winding 14 of the transformer is connected at one side directly to the secondary winding 15 of a mains supply transformer 16, the primary winding 17 of which is provided with power through the terminals marked N and L in the diagram. The other end of the primary winding 14 of the spark transformer 11 is intermittently supplied with power through a circuit including relay contacts RL1-1 and a silicon controlled rectifier SCR1 which controls the intermittent discharge of a capacitor C3 through the primary winding 14.

In more detail, the operation of the circuit shown in FIG. 1 will now be explained with reference to FIGS. 1-4 of the drawings.

In order to produce a spark at electrode 13, relay RL1 is operated to close contacts RL1-1. The operation is effected by an AC signal connected through the push button (not shown) to a rectifying circuit incorporating diode D4, resistor R5 and a capacitor C4 of 0.8 microfarads, producing a direct current through RL1 which holds contacts RL1-1 closed for a period during which power is supplied to D4.

Before RL1 is operated, assuming the mains supply to the transformer 16 is connected, the contacts RL1-1 are open and the circuit operates as shown in FIG. 2, the primary winding 14 of the spark transformer 11 being disconnected from the rest of the circuit. Since there is no DC path through capacitor C1 the voltage at point A will be zero. However, there will be an AC voltage present at A equal to the output voltage of the transformer 16.

FIG. 3 shows the operation of the circuit to produce a series of sparks at electrode 13. The relay contacts RL1-1 are closed by operation of relay RL1 and the resulting circuit, as shown in FIG. 3, provides intermittent triggering of SCR1 whenever the gate-cathode voltage determined by resistors R3 and R4 and R6 (R3 has a resistance of 100,000 ohms and R4 a resistance of 10,000 ohms; R6 has a resistance of 1,000 ohms) rises above its threshold level in each positive half-cycle of the AC supply. During negative half-cycles, capacitor C3 (4.4 microfarads) is charged through diode D3, and during the positive half-cycles C3 is discharged through SCR1 when triggering of SCR1 takes place. The discharge of C3 through SCR1 and the primary 14 of the transformer 11 produces a spark at electrode 13.

Capacitor C1 (0.1 microfarads), which is of the low-leakage type, has a central function in monitoring the presence of a spark (and also, as will be explained later, a flame). Each time the charge on capacitor C3 is discharged into the primary 14 of the transformer 11 a varying unidirectional current flows through diode D3 and capacitor C1 causing C1 to charge so that the voltage at A becomes positive with respect to earth E. Thus operation of the circuit to produce a spark establishes a positive voltage at A, and in a practical circuit this voltage may be of the order of 180 volts.

After the operation of the circuit to produce sparking at electrode 13, the operator releases the push button controlling RL1 and thus opening contacts RL1-1. The circuit can now operate to monitor the presence of a flame in the vicinity of the electrode 13 using the effect that the presence of a flame produces ionised gas around the electrode which conducts electricity unidirectionally to earth, thus acting effectively as a diode D20. A circuit is now established connecting the end 21 of the secondary winding 15 through the primary 14 and secondary 12 of transformer 11, and through the diode D20 to earth, the ionised gas circuit (which is shown in the broken-line box F in FIG. 4) having a high resistance indicated by resistor 22. When the voltage at B becomes positive the flame conducts a current, holding that voltage approximately at earth potential and causing the voltage at A to become negative. During the opposite half cycle when the voltage at B goes negative there is no conduction through the flame and the capacitor C1 remains charged, the voltage at A remaining negative. In a practical circuit the negative voltage to which C1 becomes charged is of the order of 90 volts.

The operations of the circuit of FIG. 1 to produced a spark and to monitor the presence of a spark and a flame as described above with reference to FIGS. 3 and 4 therefore have the effect of producing at A a positive voltage when the circuit is producing a spark, and a negative voltage when the circuit is operating in the flame detection mode and a flame is present. This polarity of operation is not however essential and the circuit could be rearranged to provide a negative voltage when producing a spark and a positive voltage when detecting a flame. It should be noted that in the spark-producing mode the voltage waveform at A has high voltage pulses superimposed on the DC level. These are suppressed by the provision of a voltage-dependent shunt resistor VDR in the circuit through a resistor R1 of 22,000 ohms from point A to output terminal M.

FIG. 5 shows the output (shown to the left of the broken line X-X) from the flame and spark monitoring circuit of FIG. 1 and its connection through terminals M and E to a detection circuit (shown to the right of the broken line X-X), The detection circuit comprises a high-impedance inverting operational amplifier 30 which is fed through a 1 megohm resistor 31 and responds to the DC voltage appearing at A, producing a negative output Vo of −4.7 volts when the DC voltage at A is +180 volts (spark present) and a positive output Vo of +4.7 volts when the DC voltage at A is −90 volts (flame present).

Zener diodes 32, 33 in parallel with a resistor 34 of approximately 200,000 ohms are connected in a feedback circuit to limit the output voltage swing to 4.7 volts in either direction and to provide additional suppression of any unwanted voltage transients. High speed diodes D1 and D2 are also provided at the input of the operational amplifier to limit the differential voltage input and thus to give further protection against voltage transients.

The output voltage Vo is arranged to operate a visual or audible display for assisting in the manual operation of a burner ignition system, or may be arranged to actuate controls to provide automatic operation of the burner gas and air valves. The apparatus for actuating such controls is conventional and does not need to be described.

In operation of the system described above to sense the presence of a flame, the negative charge on capacitor C1 is built up by pulses of current conducted through the flame. By using a low-leakage capacitor and ensuring that the input impedance of the detection circuit is high, the time constant for the discharge of C1 is kept to a high value and this has the advantage that a "flame-on" indication persists during short-term fluctuations caused by any flickering or weakening of the amount of ionisation in the flame which may occur. Over-rapid operation of the system to shut off the pilot gas valve is therefore avoided, and the system is sensitive and adequately responsive to relatively weak flames.

Figure 6:
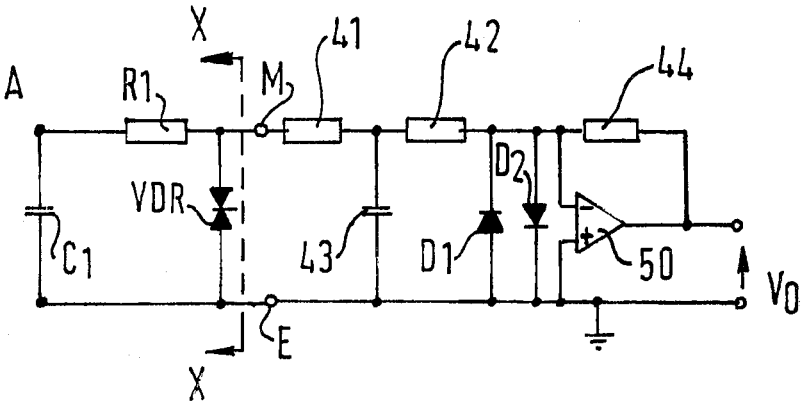
FIG. 6 is a circuit diagram showing an alternative to the part of the circuit shown in FIG. 5.

FIG. 6 shows an alternative detection circuit from that shown in FIG. 5. The circuit of FIG. 6 has the advantage that it does not respond to false signals resulting from a short circuit between the sparking electrode and earth or other failure of the ignition circuit. For this purpose, the circuit shown in FIG. 6 differs from that shown in FIG. 5 in that it comprises a low-pass filter network including resistors 41, (1 megohm) and 42, (470,000 ohms) and capacitor 43, (0.47 microfarads). When a short circuit occurs, for example as a result of mechanical damage to the sparking electrode or moisture or other contamination in the area of the electrode, an AC signal appears at point A and in some circumstances might actuate the detection circuit. To avoid such actuation, which could lead to a main gas valve being turned on when no pilot flame was in fact present, the low-pass filter network is provided to attenuate such an AC signal to near-zero voltage.

A further difference between the circuits of FIG. 5 and FIG. 6 is that in FIG. 6 the level to which the output voltage may rise is limited by the supply voltage level rather than by the Zener diodes 32, 33 of FIG 5. A feedback resistor 44 provides the required gain control.

The invention described above has the advantage that a single electronic circuit is employed, together with a single spark and sensing electrode, to provide means for producing a spark, monitoring the production of the spark, and monitoring the subsequent production of a flame. By arranging for the electronic components to perform in many instances dual or triple functions the complexity and cost of the circuit is reduced, and by virtue of the use of a small number of components reliability is increased.

Figure 7:
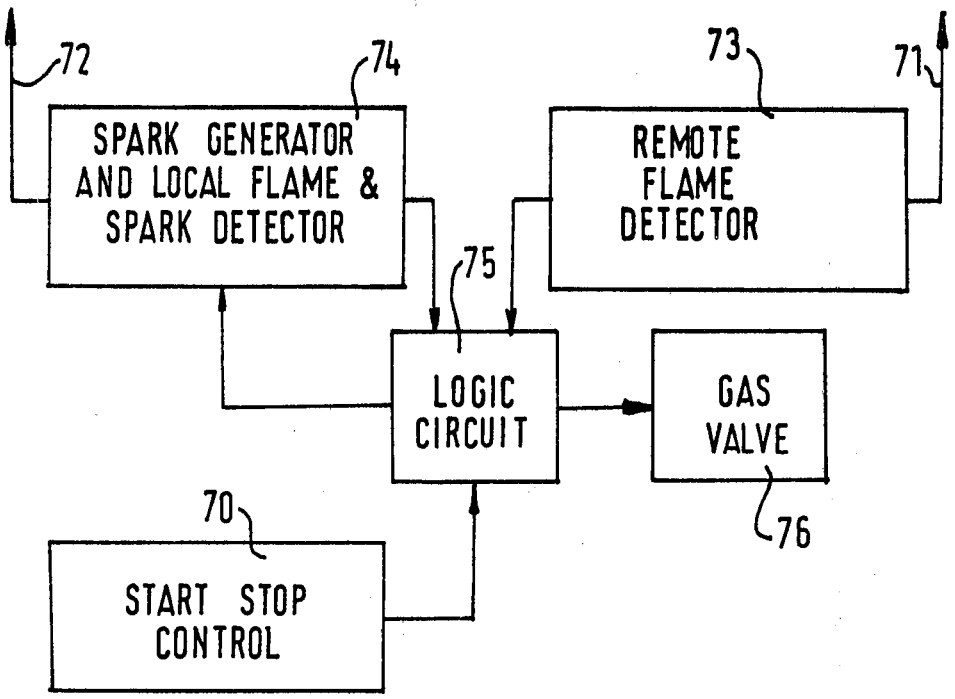
FIG. 7 is a block diagram of a modified system in accordance with the invention.

FIG. 7 illustrates a modified system in accordance with the invention which is of particular value in its application to large burner installations in which ignition at one point is intended to cause the spread of flame, for example, along a long line of jets after actuation by a start/stop control 70. Owing to blockages occurring in one or more such jets areas of the burner installation may fail to light, and to prevent the possible adverse consequences on burner performance and dangers of explosion inherent in such a situation the system of FIG. 7 provides a remote flame sensing electrode 71 which detects the presence of a flame in a position distant from the position of the pilot flame ignition electrode 72, e.g. at the opposite end from the pilot flame of a line of gas jets.

The electrode 71 is connected to a remote flame detector circuit 73 similar to the spark generator and local flame detector circuit 74 which is as shown in FIGS. 1 and 5, incorporating a capacitor (not shown) which is arranged to be charged negatively when a flame is established in the vicinity of the electrode 71. The operation of the circuit 73 results in a positive output which is fed to a logic circuit 75 together with the output from the detector circuit associated with the local flame detector electrode 72 to cause a main gas valve 76 to be closed if no flame signal appears both at the local sensing electrode 72 and the remote sensing electrode 71 within three seconds following ignition of the pilot flame.

Having now described our invention, what we claim is:

1. An electrical igniton system for a burner comprising a spark generation circuit, means for monitoring the production of a spark comprising a capacitor, means for charging said capacitor in one sense by operation of the spark generation circuit, means for monitoring the presence of a flame at a first location comprising means responsive to the flame for producing a charge on said capacitor in the opposite sense to that produced by operation of the spark generation circuit, and means for detecting the presence and polarity of a charge on said capacitor to detect that sparks have been produced and that said flame has been produced.

2. An electrical ignition system according to claim 1 wherein the means for detecting the presence and polarity of a charge on the said capacitor comprises an amplifier which is arranged to provide outputs of differing polarity according to the polarity of the charge on the capacitor.

3. An electrical ignition system according to claim 2 wherein the amplifier comprises a low-pass filter arranged to prevent the amplifier from responding to false AC signals resulting from a short circuit or failure of the spark generation circuit.

4. An electrical ignition system according to claim 1 wherein said capacitor is arranged to be charged in the positive sense by operation of the spark generation circuit and in the negative sense by operation of the means for monitoring the presence of a flame.

5. An electrical ignition system according to claim 1 wherein a single electrode is used for spark production and flame detection.

6. An electrical ignition system according to claim 1 further comprising a line of burners along which said flame propogates and a remote flame sensing electrode provided at a second location adjacent said burners and removed from said first location; said second location receiving a flame propogated along said line of burners from said first location, said remote flame sensing electrode detecting the presence of a flame at said second location.

7. An electrical ignition system according to claim 6 further comprising means connected to said remote flame sensing electrode for preventing the supply of fuel to said line of burners if no flame is sensed by the remote flame sensing electrode within a predetermined time following ignition of a pilot flame.

* * * * *